US007824118B2

(12) United States Patent
Sugiyama

(10) Patent No.: US 7,824,118 B2
(45) Date of Patent: Nov. 2, 2010

(54) PRINTER COMPRISING A FLEXIBLE MEMBER EXTENDING OVER THE ANTENNAS OF RFID LABELS WOUND ON A ROLL

(75) Inventor: Makoto Sugiyama, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 646 days.

(21) Appl. No.: 11/788,336

(22) Filed: Apr. 19, 2007

(65) Prior Publication Data

US 2007/0245913 A1 Oct. 25, 2007

(30) Foreign Application Priority Data

Apr. 25, 2006 (JP) ..... 2006-120383
Apr. 25, 2006 (JP) ..... 2006-120384

(51) Int. Cl.
*B41J 29/00* (2006.01)
*G06K 7/00* (2006.01)

(52) U.S. Cl. ..... 400/679; 400/76; 235/451; 235/472.02; 340/572.1

(58) Field of Classification Search ..... None
See application file for complete search history.

(56) References Cited

U.S. PATENT DOCUMENTS 6,327,972 B2 * 12/2001 Heredia et al. ..... 101/35
6,409,401 B1 * 6/2002 Petteruti et al. ..... 400/88
6,848,616 B2 * 2/2005 Tsirline et al. ..... 235/449
2004/0134620 A1 7/2004 Soeborg
2004/0178267 A1 * 9/2004 Tsirline et al. ..... 235/449
2005/0045723 A1 3/2005 Tsirline et al.
2006/0071063 A1 * 4/2006 Duckett ..... 235/375
2006/0082446 A1 * 4/2006 Dods ..... 340/10.51

(Continued)

FOREIGN PATENT DOCUMENTS

EP 1 674 272 A1 6/2006

(Continued)

OTHER PUBLICATIONS

Related U.S. Appl. No. 12/075,251, filed Mar. 10, 2008, Title: Label Printer, Computer Program for the Label Printer, and Computer Program, Inventor: Makoto Sugiyama.

(Continued)

*Primary Examiner*—Jill E Culler
(74) *Attorney, Agent, or Firm*—Patterson & Sheridan, LLP

(57) ABSTRACT

A printer according to the present invention includes a sheet holder, a feed/print mechanism, an RFID reader/writer, and a flexible member including electrically conductive metal. The sheet holder holds a sheet of label paper wound into a roll. The sheet of label paper includes a mount and RFID labels stuck on the mount. Each of the labels includes an IC chip and an antenna connected to the chip. The feed/print mechanism for unwinds the held sheet of label paper, feeds the unwound sheet along the sheet path, and makes prints on the RFID labels of the sheet being fed. The RFID reader/writer writes information on the IC chips of the RFID labels of the sheet being fed along the sheet path. The flexible member extends over the antennas of the RFID labels of the held sheet of label paper and curves in contact with the outer periphery of the held sheet.

9 Claims, 6 Drawing Sheets

U.S. PATENT DOCUMENTS

| | | | |
|---|---|---|---|
| 2006/0138229 | A1 | 6/2006 | Sugiyama |
| 2007/0014615 | A1 | 1/2007 | Kasayama et al. |
| 2007/0120670 | A1 | 5/2007 | Torchalski |
| 2007/0138281 | A1 | 6/2007 | Moriyama et al. |
| 2007/0268322 | A1 | 11/2007 | Kyoi |

FOREIGN PATENT DOCUMENTS

| | | | |
|---|---|---|---|
| EP | 1 705 025 | A1 | 9/2006 |
| EP | 1 801 733 | A1 | 6/2007 |
| JP | 2005-284747 | A | 10/2005 |

OTHER PUBLICATIONS

Extended European Search Report dated Jul. 8, 2008 issued in counterpart European Appln. No. 08001254.5 of related U.S. Appl. No. 12/075,251.

* cited by examiner

PRINTER COMPRISING A FLEXIBLE MEMBER EXTENDING OVER THE ANTENNAS OF RFID LABELS WOUND ON A ROLL

CROSS REFERENCE TO RELATED APPLICATION

The present application is based on Japanese Priority Documents P2006-120383 filed on Apr. 25, 2006 and P2006-120384 filed on Apr. 25, 2006, the content of which is incorporated herein by reference.

BACKGROUND OF THE INVENTION

1. Field of the Invention

The present invention relates to a printer for holding a sheet of label paper wound into a roll, which includes RFID (radio frequency identification) labels, unwinding the held sheet, feeding the unwound sheet, writing information on the labels, and making prints on the labels.

2. Description of Related Art

RFID labels are used for article management employing RFID technique. Bar codes and/or other information can be printed on RFID labels. An antenna and an IC chip are buried in each RFID label so that information can be written on and read from the label.

A conventional printer includes a sheet holder and an RFID reader/writer. The sheet holder holds a sheet of label paper wound into a roll, which consists of a long mount and RFID labels stuck on the mount. The printer unwinds the held sheet of label paper and makes prints on the RFID labels while the unwound sheet is fed. While the unwound sheet is fed, the RFID reader/writer writes information on the RFID labels by communicating by radio with them. The RFID reader/writer may erroneously write information on the RFID labels at the outer periphery of the wound sheet, not the RFID labels of the sheet being fed.

For example, JP2005-335737A discloses a printer fitted with a shield plate in it, on both sides of which two spaces are formed. An RFID reader/writer is fitted in one of the spaces. A sheet of label paper wound into a roll is supported in the other space, which is a nonreceipt space where the electric waves etc. from the RFID reader/writer cannot be received so that erroneous writing can be prevented.

It is necessary to form between the shield plate and a casing a gap through which the sheet of label paper passes. The gap prevents the shield plate from shutting off the two spaces completely from each other. Also, a space is formed around the sheet of label paper wound into a roll in the nonreceipt space. The electric waves emitted from the RFID reader/writer pass through the slight gap into the nonreceipt space and pass the space around the sheet of label paper wound into a roll, and may cause erroneous writing on the IC chips of the RFID labels of the wound sheet.

In particular, in an RFID technique using an UHF for radio communication, which is expected to come into wide use, electric waves are reflected in the printer and easily reach the wound sheet of label paper.

Accordingly, an object of the present invention is to provide a printer which prevents erroneous writing on RFID labels at the outer periphery of a sheet of label paper wound into a roll and supported in the printer.

SUMMARY OF THE INVENTION

According to one aspect of the present invention, a printer is provided which includes: a sheet holder, a feed/print mechanism, an RFID reader/writer, and a flexible member. The sheet holder holds a sheet of label paper wound into a roll. The sheet of label paper includes a mount and RFID labels stuck on the mount. Each of the labels includes an IC chip and an antenna connected to the chip. The feed/print mechanism unwinds the held sheet of label paper, feeds the unwound sheet along the sheet path, and makes prints on the RFID labels of the sheet being fed. The RFID reader/writer writes information on the IC chips of the RFID labels of the sheet being fed along the sheet path. The flexible member extends over the antennas of the RFID labels of the held sheet of label paper, curves in contact with the outer periphery of the held sheet, and includes electrically conductive metal.

According to another aspect of the present invention, a printer is provided which includes: a sheet holder, a feed/print mechanism, an RFID reader/writer, and a flexible member. The sheet holder holds a sheet of label paper wound into a roll. The sheet of label paper includes a mount and RFID labels stuck on the mount. Each of the labels includes an IC chip and an antenna connected to the chip. The feed/print mechanism unwinds the held sheet of label paper, feeds the unwound sheet along the sheet path, and makes prints on the RFID labels of the sheet being fed. The RFID reader/writer writes information on the IC chips of the RFID labels of the sheet being fed along the sheet path. The flexible member extends over the antennas of the RFID labels of the held sheet of label paper, covers the outer periphery of the held sheet, and can absorb electromagnetic waves.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Detailed description of the invention will be described by way of example with reference to the accompanying drawings.

Figure 1:
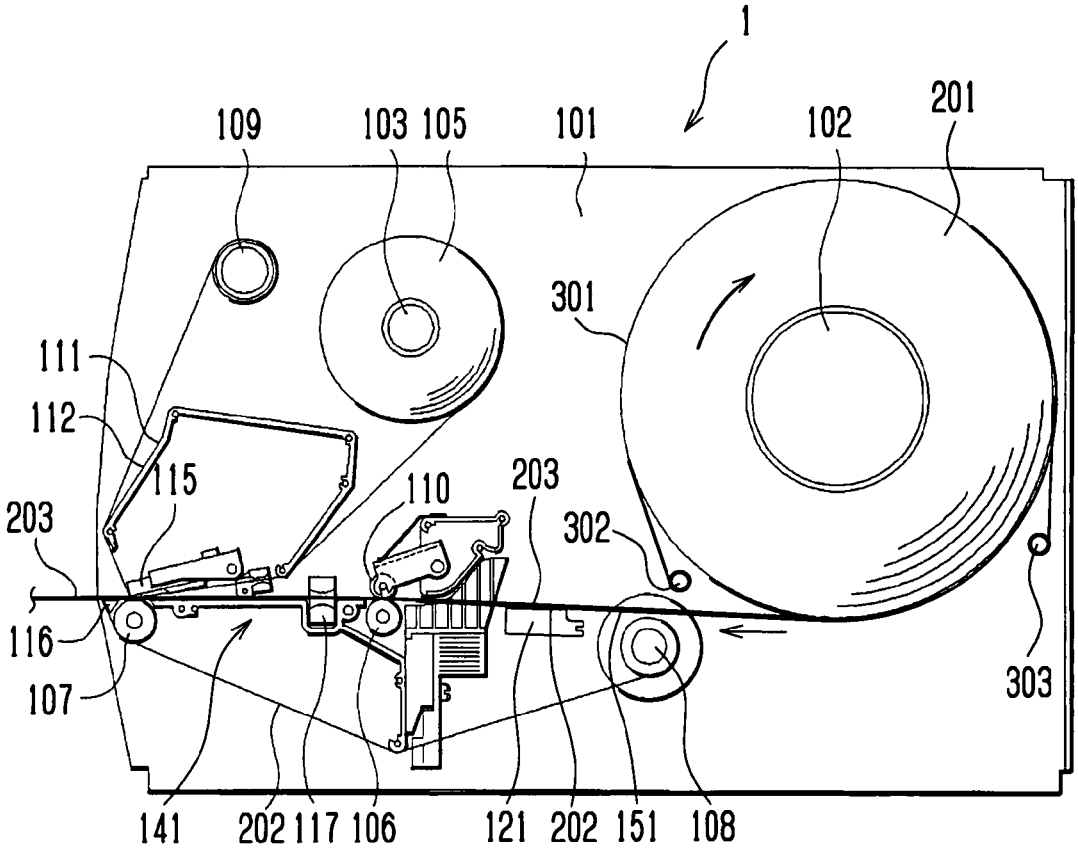
FIG. 1 is a side view in longitudinal section of a printer embodying the present invention.

With reference to FIG. 1, a printer 1 embodying the present invention includes a main body 101, to which one end of a sheet supporting shaft 102 and one end of an ink ribbon supporting shaft 103 are fixed. A sheet of label paper 201 and an ink ribbon 105 each of which is wound into a roll can be supported rotatably on the shafts 102 and 103 respectively.

Figure 4:
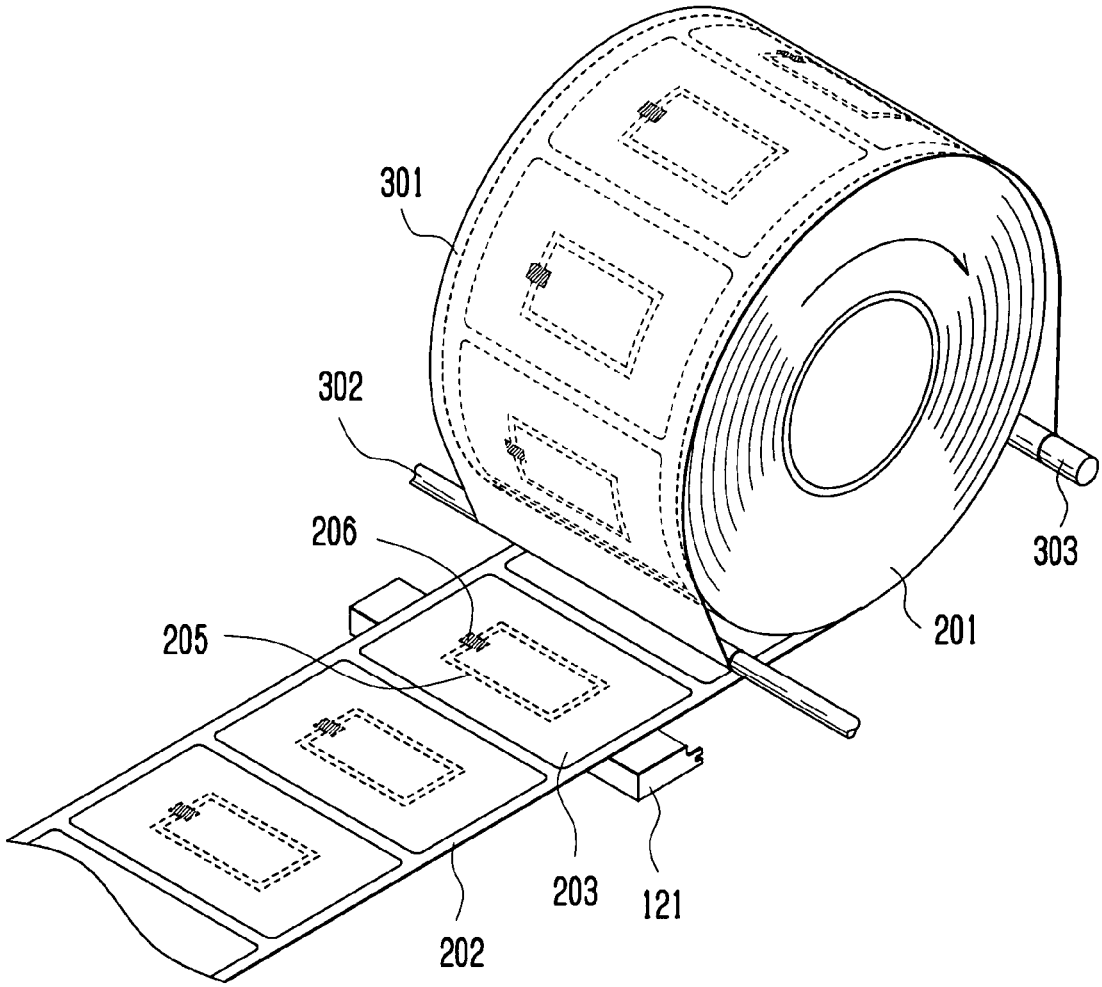
FIG. 4 is a perspective view of part of the printer, showing a flexible member curving in contact with a sheet of label paper loaded in the printer.
Figure 5:
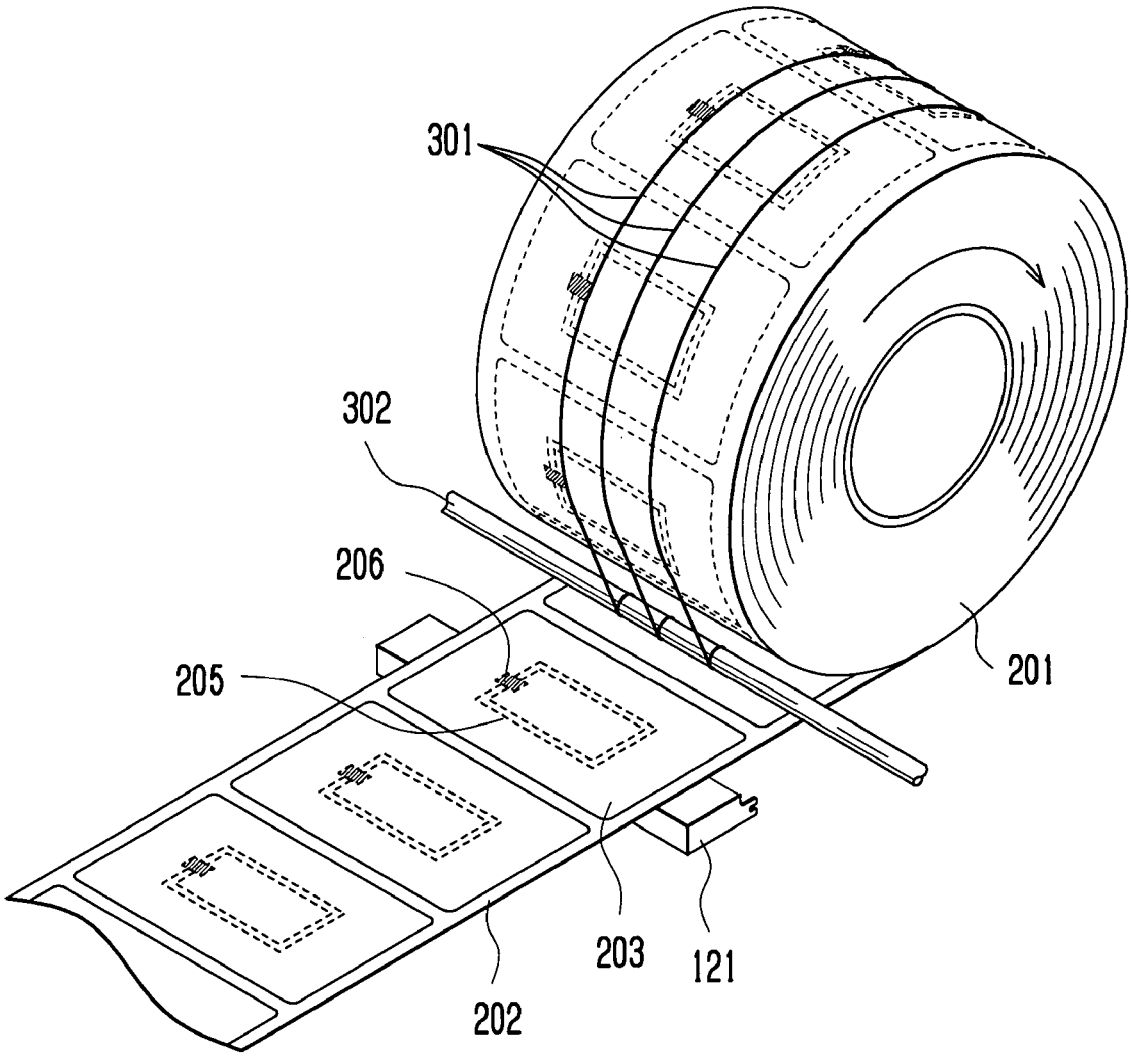
FIG. 5 is a perspective view of part of the printer, showing other flexible members curving in contact with a sheet of label paper loaded in the printer.
Figure 7:
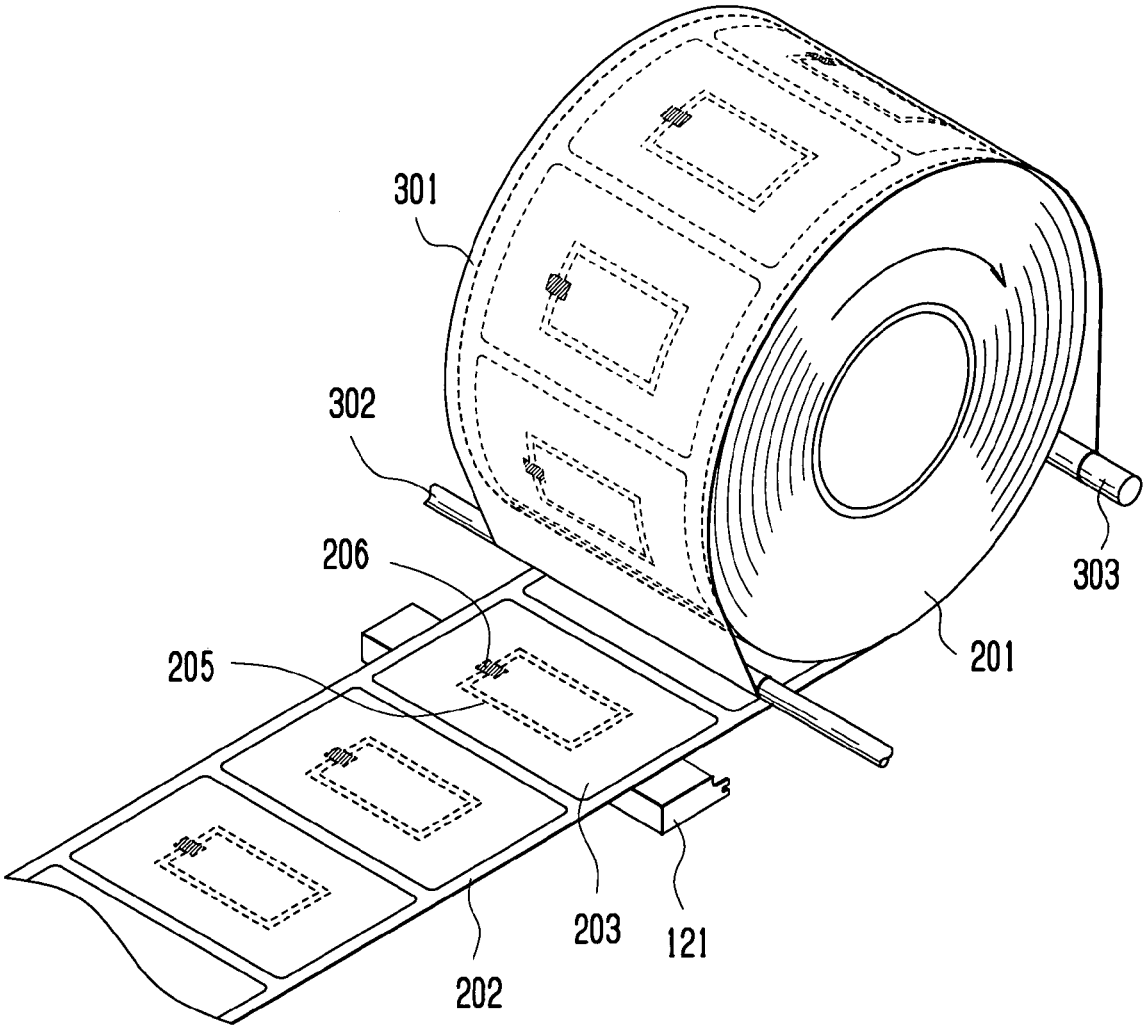
FIG. 7 is a perspective view of part of the printer, showing still another flexible member curving in contact with a sheet of label paper loaded in the printer.

With reference to FIG. 4, 5, or 7, the sheet of label paper 201 consists of a long mount 202 and a number of RFID labels 203 stuck at regular intervals on the mount 202. Each RFID label 203 includes an IC chip 206 and an antenna 205 which are buried in it and connected together.

The printer 1 is fitted with a flexible member 301 for contact with the outer periphery of the wound sheet of label paper 201 on the shaft 102. The flexible member 301 includes electrically conductive metal or is metallic. As shown in FIG. 4, the flexible member 301 may be a strip of cloth woven with copper fibers over its whole. A fixing shaft 302 is positioned in front of and below the sheet supporting shaft 102. One end of the fixing shaft 302 is fixed to the printer body 101. One end of the strip of cloth 301 is wound on and fixed to the fixing shaft 302. The other end of the strip 301 is free and wound on a weight 303.

The printer 1 also includes a feed/print mechanism 141 for unwinding the sheet of label paper 201 supported on the shaft 102, feeding the unwound sheet 201, and making prints on the RFID labels 203 of the sheet being fed. The feed/print mechanism 141 includes a feed roller 106, a pinch roller 110, a platen 107, and a thermal head 115. One end of the feed roller 106, one end of the platen 107, one end of a rewinder 108, and one end of a ribbon winding shaft 109 are supported rotatably by the printer body 101. The feed roller 106, the platen 107, the rewinder 108, and the winding shaft 109 are connected to a motor (not shown) for rotating them. The pinch roller 110 is biased with a preset pressure toward the feed roller 106 so as to come into contact with the cylindrical surface of the feed roller when the sheet of label paper 201 is not fed. The platen 107 is positioned adjacently under a head block 111, which consists of a casing 112 and the thermal head 115. The casing 112 is fixed to the printer body 101 and open at it bottom. The thermal head 115 is biased toward the platen 107 so as to come into contact with the cylindrical surface of the platen when the sheet of label paper 201 is not fed.

After the sheet of label paper 201 supported on the shaft 102 is unwound, the sheet 201 is fed along a sheet path 151 leading through the nip between the feed roller 106 and the pinch roller 110 and the nip between the platen 107 and the thermal head 115. After the sheet 201 passes through the nip between the platen 107 and the thermal head 115, its mount 202 is bent down by a label release 116 and subsequently wound up on the rewinder 108, while the RFID labels 203 are released from the mount 202 and pass straight. In the meantime, after the ink ribbon 105 supported on the shaft 103 is rewound, the ribbon 105 is fed through the nip between the platen 107 and the thermal head 115 and subsequently wound up on the winding shaft 109.

The rotation of the feed roller 106 and platen 107 at preset speeds unwinds the sheet of label paper 201 and feeds the unwound sheet along the path 151 at a preset speed. While the sheet 201 is fed along the path 151, the thermal head 115 prints information on the RFID labels 203. In the meantime, the rotation of the ribbon winding shaft 109 at a preset speed feeds the ink ribbon 105 at the same speed as the sheet 201 is fed.

A feed sensor 117 is fitted between the feed roller 106 and the platen 107 and senses the feed of the sheet of label paper 201. The sensed feed is the basis for controlling the feed of the sheet 201 and ink ribbon 105 so as to make prints in position on the RFID labels 203.

The printer 1 further includes an RFID reader/writer 121 fixed to the printer body 101. The reader/writer 121 is positioned between the feed roller 106 and the rewinder 108 and on the under side of the sheet path 151. When each RFID label 203 of the sheet 201 being fed is positioned over the reader/writer 121, the reader/writer 121 writes information on the label 203 by communicating by radio with the label.

Figure 2:
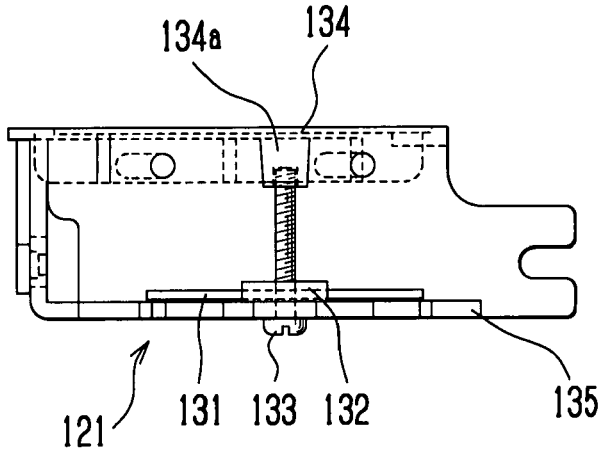
FIG. 2 is an enlarged side view in longitudinal section of the RFID reader/writer of the printer.
Figure 3:
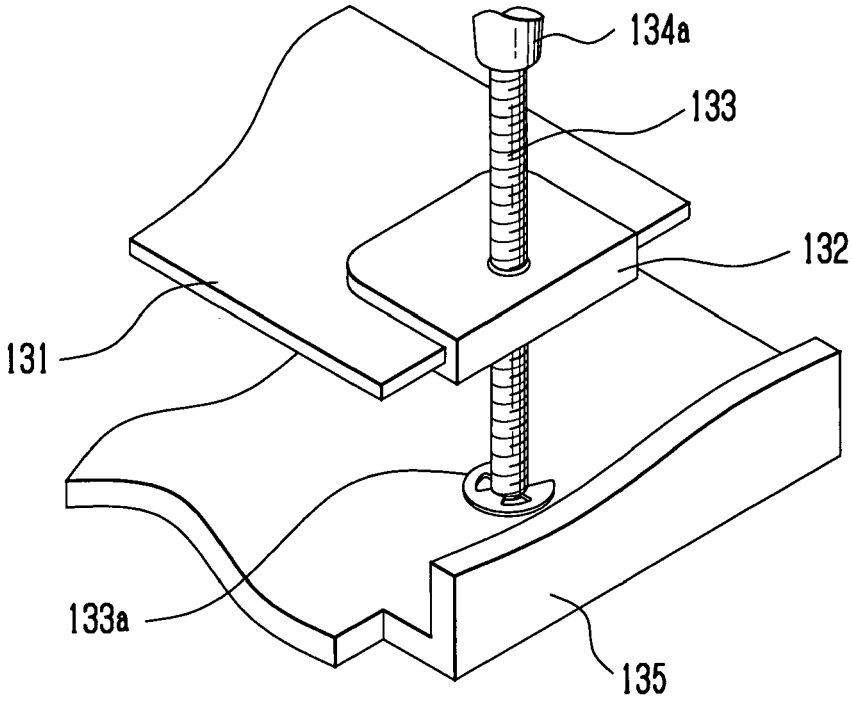
FIG. 3 is an enlarged perspective view of part of the RFID reader/writer.

With reference to FIGS. 2 and 3, the RFID reader/writer 121 includes an antenna 131 through which it reads information from and writes information on the IC chip 206 positioned over it. The reader/writer 121 also includes a pair of fixing plates 132, a pair of screws 133, and a frame 135. The frame 135 is fixed to the printer body 101 and includes an antenna panel 134 formed at its top. The frame 135 has a pair of holes formed through its bottom. The panel 134 has a pair of bosses 134*a* formed on its under side, each in vertical alignment with one of the frame holes. The fixing plates 132 have tapped holes formed through them. Each screw 133 extends loosely through one of the frame holes, with its head positioned on the under side of the frame 135, and is kept by a screw retainer 133*a* from moving vertically. The other end of each screw 133 is seated rotatably in the associated panel boss 134*a*. Each screw 133 engages with the tapped holes of one of the fixing plates 131. Each fixing plate 132 grips one end of the antenna 131. The rotation of the screws 133 varies the vertical position of the antenna 131.

With reference to FIG. 4, 5, or 7, the RFID labels 203 are of the passive type and have no batteries fitted in them. The labels 203 may be supplied with electric power by means of electromagnetic induction at a frequency of 13.56 MHz. In this case, the buried antenna 205 of each label 203 receives the magnetic field from the reader/writer antenna 131. The received field generates electric power in the buried antenna 205, thereby activating the associated IC chip 206. Alternatively, the labels 203 may be supplied with electric power by means of electric waves at an UHF. In this case, each buried antenna 205 receives electric waves from the reader/writer antenna 131. The received waves generate electric power in the buried antenna 205, thereby activating the associated IC chip 206. The activation of each IC chip 206 enables the associated label 203 to communicate by radio with the reader/writer 121.

With reference to FIG. 4, the strip of cloth 301 is put on an upper portion of the outer periphery of the wound sheet of label paper 201. The flexibility and weight of the strip 301 curve it along and in contact with the sheet periphery. The weight 303 on the free end of the strip 301 increases the weight of this member, further stabilizing the position of the strip 301 along the sheet periphery.

It is essential that the strip of cloth 301 should cover the buried antennas 205 of RFID labels 203 at the outer periphery of the wound sheet 201 supported on the shaft 102 and be in contact with the sheet periphery. This makes these antennas 205 close to the metal of the strip 301. The characteristics of the buried antennas 205 are so designed that the RFID labels 203 can communicate by radio with the RFID reader/writer 121. The metal close to the buried antennas 205 of RFID labels 203 at the sheet periphery changes the characteristics of these antennas, so that these labels 203 cannot communicate by radio with the reader/writer 121. This prevents erroneous writing on RFID labels 203 at the sheet periphery even if the magnetic field etc. from the reader/writer 121 reaches these labels.

The strip of cloth 301 is wider than the sheet of label paper 201, as shown in FIG. 4, but might not be wider than it. The strip 301 might be narrower than the sheet 201 as far as the strip 301 covers the buried antennas 205.

With reference to FIG. 1, the free end of the flexible member 301 is downstream from the fixed end of the member in the direction in which the wound sheet of label paper 201 rotates on the shaft 102 by being unwound. This keeps the flexible member 301 from shifting or falling by being pulled by the rotation of the wound sheet 201. Even when the wound sheet 201 decreases in diameter, the flexible member 301 keeps in contact with the outer periphery of the wound sheet 201. The weight 303 on the free end or ends of the flexible member 301 increases the weight of this end or these ends, thereby keeping the end or ends from floating up. This keeps the flexible member 301 in closer contact with the outer periphery of the wound sheet 201.

Whether the free end or ends of the flexible member 301 float up or not depends on the weight of the member etc. Therefore, the free end or ends could, even without the weight 303 fitted, be kept from floating up. The weight 303 could be omitted even if the omission might allow the free end or ends to float up to some extent.

FIG. 5 shows another example of the flexible member 301. The parts shown in FIG. 5 which are identical with the counterparts in FIG. 4 are indicated with the same numerals as the counterparts are indicated, and the description of the parts will be omitted. As stated already and shown in FIG. 4, the flexible member 301 may take the form of a sheet covering the outer periphery of the wound sheet of label paper 201. Alternatively, as shown in FIG. 5, the flexible member 301 may be metal wires as far as they can change the characteristics of the buried antennas 205 of RFID labels 203 at the outer periphery of the wound sheet 201 by being close to these antennas.

Figure 6:
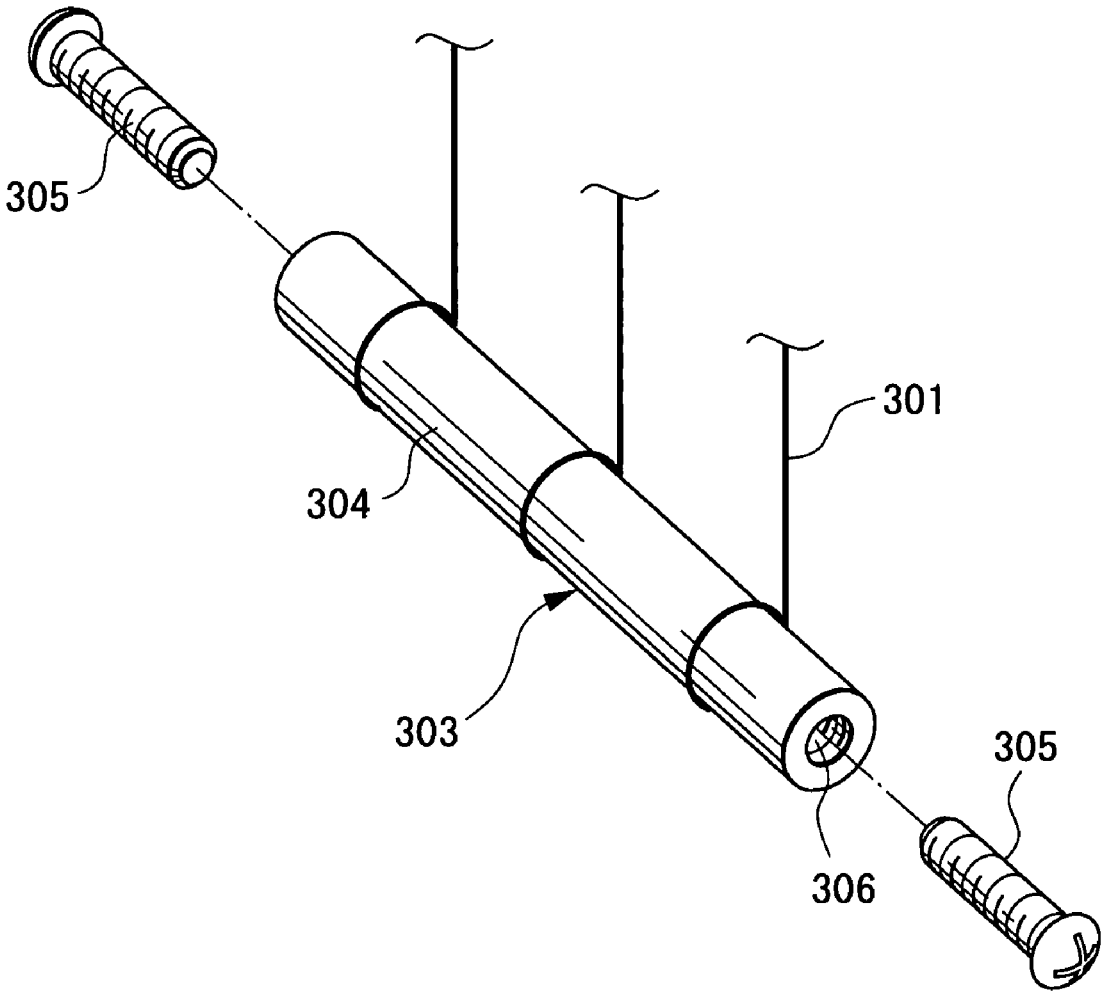
FIG. 6 is an enlarged perspective view of the weight fitted to the free ends of the flexible members shown in FIG. 5.

One end of each metal wire 301 is wound on and fixed to the fixing shaft 302. As shown in FIG. 6, the free ends of the wires 301 are fixed to a weight 303, which consists of a cylindrical body 304 and a pair of screws 305. The cylindrical body 304 has a pair of tapped holes 306 formed in its ends. Each screw 305 engages with one of the tapped holes 306.

As shown in FIG. 5, the metal wires 301 are in contact with the outer periphery of the wound sheet of label paper 201 and extend across the buried antennas 205 of RFID labels 203 positioned at the sheet periphery. The metal wires 301 change the characteristics of these antennas 205, so that these labels 203 cannot communicate by radio with the RFID reader/writer 121. This prevents erroneous writing on these labels 203.

The metal wires 301 are shown as three in number in FIG. 5, but the number of metal wires 301 is not limited to three as far as they can prevent erroneous writing on the RFID labels 203.

FIG. 7 shows still another example of the flexible member 301. The parts shown in FIG. 7 which are identical with the counterparts in FIG. 4 are indicated with the same numerals as the counterparts are indicated, and the description of the parts will be omitted. As shown in FIG. 7, the flexible member 301 may be a flexible sheet which can absorb electromagnetic waves. The flexible sheet 301 may include ferrite or another magnetic material, which absorbs the magnetic field components of electromagnetic waves and converts them into heat, so that the flexible sheet 301 absorbs the waves.

It is essential that the flexible sheet 301 should cover the buried antennas 205 of RFID labels 203 at the outer periphery of the wound sheet of label paper 201 supported on the shaft 102. Even if the magnetic field etc. from the RFID reader/writer 121 reach these labels 203, the flexible sheet 301 covering these antennas 205 absorbs the field etc., so that erroneous writing on these labels 203 is prevented.

Obviously, numerous modifications and variations of the present invention are possible in light of the above description of the present invention. It is therefore to be understood that within the scope of the appended claims, the invention may be practiced otherwise than as specifically described herein.

What is claimed is:

1. A printer comprising:

a sheet holder for holding a sheet of label paper wound into a roll, the sheet including a mount and a plurality of RFID labels stuck on the mount, the labels each including an IC chip and an antenna connected to the chip;

a feed/print mechanism for unwinding the held sheet of label paper, feeding the unwound sheet along a sheet path, and printing on the RFID labels of the sheet being fed;

an RFID reader/writer for writing information on the IC chips of the RFID labels of the sheet being fed along the sheet path; and a flexible member extending over the antennas of the RFID labels of the held sheet of label paper and curving in contact with an outer periphery of the held sheet of label paper wound into the roll, the flexible member including electrically conductive metal.

2. The printer according to claim 1, wherein the flexible member includes:

a fixed end fixed relative to the sheet holder; and a free end downstream from the fixed end in a direction in which the held sheet of label paper rotates by being unwound by the feed/print mechanism.

3. The printer according to claim 2, further comprising a weight fitted to the free end of the flexible member.

4. The printer according to claim 1, wherein the flexible member has the form of a sheet.

5. The printer according to claim 4, wherein the flexible member includes a base sheet and an electric conductor fitted to the base sheet.

6. The printer according to claim 5, wherein the base sheet comprises a strip of cloth.

7. The printer according to claim 6, wherein the conductor comprises metal fiber, and wherein the strip of cloth is woven with the fiber.

8. The printer according to claim 1, wherein the flexible member has a linear form.

9. The printer according to claim 8, wherein the flexible member comprises a metal wire.

* * * * *